US007377009B2

(12) United States Patent
Lee et al.

(10) Patent No.: US 7,377,009 B2
(45) Date of Patent: May 27, 2008

(54) MULTI-FUNCTIONAL CLEANER SELECTIVELY PERFORMING VACUUM CLEANING AND WATER CLEANING

(75) Inventors: Yong Woo Lee, Seoul (KR); Choon Myun Chung, Gyeonggi-Do (KR); Ho Seon Rew, Seoul (KR); Hyeun Sik Nam, Seoul (KR)

(73) Assignee: LG Electronics Inc., Seoul (KR)

( * ) Notice: Subject to any disclaimer, the term of this patent is extended or adjusted under 35 U.S.C. 154(b) by 752 days.

(21) Appl. No.: 10/879,106

(22) Filed: Jun. 30, 2004

(65) Prior Publication Data

US 2005/0198763 A1 Sep. 15, 2005

(30) Foreign Application Priority Data

Mar. 9, 2004 (KR) ..... 10-2004-0015922
Mar. 9, 2004 (KR) ..... 10-2004-0015923

(51) Int. Cl.
*A47L 7/00* (2006.01)

(52) U.S. Cl. ..... 15/331; 15/328; 15/322; 15/353; 15/416

(58) Field of Classification Search ..... 15/320, 15/322, 353, 328, 331, 416
See application file for complete search history.

(56) References Cited

U.S. PATENT DOCUMENTS 4,138,761 A 2/1979 Nauta
4,167,800 A 9/1979 Tribolet
4,216,563 A * 8/1980 Cyphert ..... 15/328
4,310,945 A 1/1982 Tribolet
4,314,385 A * 2/1982 Wimsatt et al. ..... 15/328
4,320,555 A 3/1982 Watson
4,367,565 A 1/1983 Parise
4,463,474 A 8/1984 Jacobs
4,864,681 A * 9/1989 Hult et al. ..... 15/367
5,398,373 A * 3/1995 Blase et al. ..... 15/322
5,416,948 A * 5/1995 Worwag ..... 15/331

FOREIGN PATENT DOCUMENTS

| | | |
|---|---|---|
| EP | 0245873 | 11/1987 |
| EP | 0176697 | 5/1990 |
| GB | 2322065 | 8/1998 |
| WO | 98/35600 | 8/1998 |

OTHER PUBLICATIONS

English language Abstract of EP 0245873.

* cited by examiner

*Primary Examiner*—Theresa T Snider
(74) *Attorney, Agent, or Firm*—Greenblum & Bernstein, P.L.C.

(57) ABSTRACT

A complex type cleaner includes: a cleaner body having at least one of a dust collecting container for storing dust or foreign materials and a water collecting container for storing contaminated water; and a suction head having a dust suction opening disposed at a lower portion of the cleaner body and sucking dust when the cleaner performs a vacuum cleaning and a suction head having a suction nozzle for sucking contaminated water when the cleaner performs a water cleaning. By implementing both vacuum cleaning function for sucking dust and water cleaning function in one cleaner, a cost can be reduced, users' convenience can be improved, and the cleaner can be conveniently kept in storage.

12 Claims, 10 Drawing Sheets

MULTI-FUNCTIONAL CLEANER SELECTIVELY PERFORMING VACUUM CLEANING AND WATER CLEANING

BACKGROUND OF THE INVENTION

1. Field of the Invention

The present invention relates to a complex type cleaner and, more particularly, to a complex type cleaner capable of selectively performing a vacuum cleaning and a water cleaning.

2. Description of the Background Art

In general, an up-right type vacuum cleaner includes a cleaner body disposed in a vertically standing state; a suction fan installed in the cleaner body and generating a suction force; a filter container having a filter for collecting dust or dirt sucked by the suction force generated by the suction fan; a suction head disposed at a lower side of the cleaner body and sucking dust or dirt at a floor; and a brush rotatably installed at the suction head and brushing up dust or dirt at the floor.

The up-right type vacuum cleaner generates a suction force when the suction fan is driven. Dust and foreign materials on a floor or a carpet are sucked through the suction head by virtue of the suction force, filtered by the filter and collected in the filter container.

Meanwhile, a general extractor includes a water supply container holding a cleansing solution; a pump for pumping the cleansing solution held in the water supply container; a spray nozzle for spraying the cleansing solution pumped by the pump to a cleaning portion; a suction nozzle for sucking the contaminated water and dust at the cleansing solution-sprayed cleaning portion; a water collecting container for storing contaminated water sucked through the suction nozzle; and a suction fan for generating a suction force to suck contaminated water through the suction nozzle.

In the extractor, when the pump is driven, the cleansing solution stored in the water supply container is sprayed onto the carpet or the like through the spray nozzle, a brush brushes the portion while being rotated, contaminated water is sucked through the suction nozzle and collected in the water collecting container, and air is discharged outwardly.

Thus, as for the conventional cleaner, a vacuum cleaner is needed to vacuum-clean dust and foreign materials and the extractor is needed to water-clean the carpet or the like, increasing a cost. In addition, since the two cleaners take much space, it is inconvenient to keep them in storage.

SUMMARY OF THE INVENTION

Therefore, an object of the present invention is to provide a complex type cleaner implementing both a vacuum cleaning function for sucking dust and a water cleaning function to thereby reduce a cost, enhance users' convenience and be convenient for storage.

To achieve these and other advantages and in accordance with the purpose of the present invention, as embodied and broadly described herein, there is provided a complex type cleaner including: a cleaner body where one of a dust collecting container for storing dust or foreign materials and a water collecting container for storing contaminated water is selectively mounted; and a suction head having a dust suction opening disposed at a lower portion of the cleaner body and sucking dust when the cleaner performs a vacuum cleaning and a suction head having a suction nozzle for sucking contaminated water when the cleaner performs a water cleaning.

The cleaner body includes a container mounting part in which one of the dust collecting container and the water collecting container is mounted, and a handle mounted at an upper portion thereof.

The cleaner body includes a washing water spray unit for spraying washing water onto a carpet when the cleaner is used in a water cleaning mode. The washing water spray unit includes a water tank mounted in the cleaner body and storing washing water; a washing water supply line connected to the water tank and supplying washing water to the carpet; a pump installed at the washing water supply line and pumping the washing water stored in the water tank; and a spray nozzle connected to an end portion of the washing water supply line and spraying the washing water pumped by the pump onto the carpet.

The dust collecting container includes: a container mounted in the container mounting part formed at the cleaner body and having a space for collecting dust; a suction passage formed at one side of the container and connected to a dust suction hose to suck dust and foreign materials into the container; a filter disposed inside the container and filtering dust and foreign materials sucked into the container; and a discharge passage formed at the container and connected to the filter in order to discharge air which has been purified while passing through the filter.

The suction head and the dust collecting container are connected by the dust suction hose so that dust sucked into the dust suction opening is guided to the dust collecting container, and the suction nozzle and the water collecting container are connected by a water suction hose so that water sucked into the suction nozzle is guided to the water collecting container.

The water collecting container includes: a container having a space for storing contaminated water; a suction pipe connected to the container and extended in a downward direction of the container so as to be connected to the water suction hose; a discharge passage formed at a lower side of the container and externally discharging air sucked together with water into the container; and a water discharge preventing unit mounted at the discharge passage and preventing contaminated water introduced into the container from being leaked through the discharge passage.

The water discharge preventing unit includes a bent pipe mounted at an end portion of the discharge passage and bent downwardly; and a cut-off valve mounted at an end portion of the bent pipe and preventing water from being discharged by blocking the end portion of the bent pipe when water introduced into the container reaches a pre-set value.

The cut-off valve includes: a valve body mounted at an end portion of the bent pipe; a floater inserted to be movable vertically inside the valve body and floated up to be tightly attached to the valve sheet formed at the bent pipe when water is filled; and a release preventing cap formed at an end portion of the valve body and preventing release of the floater.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
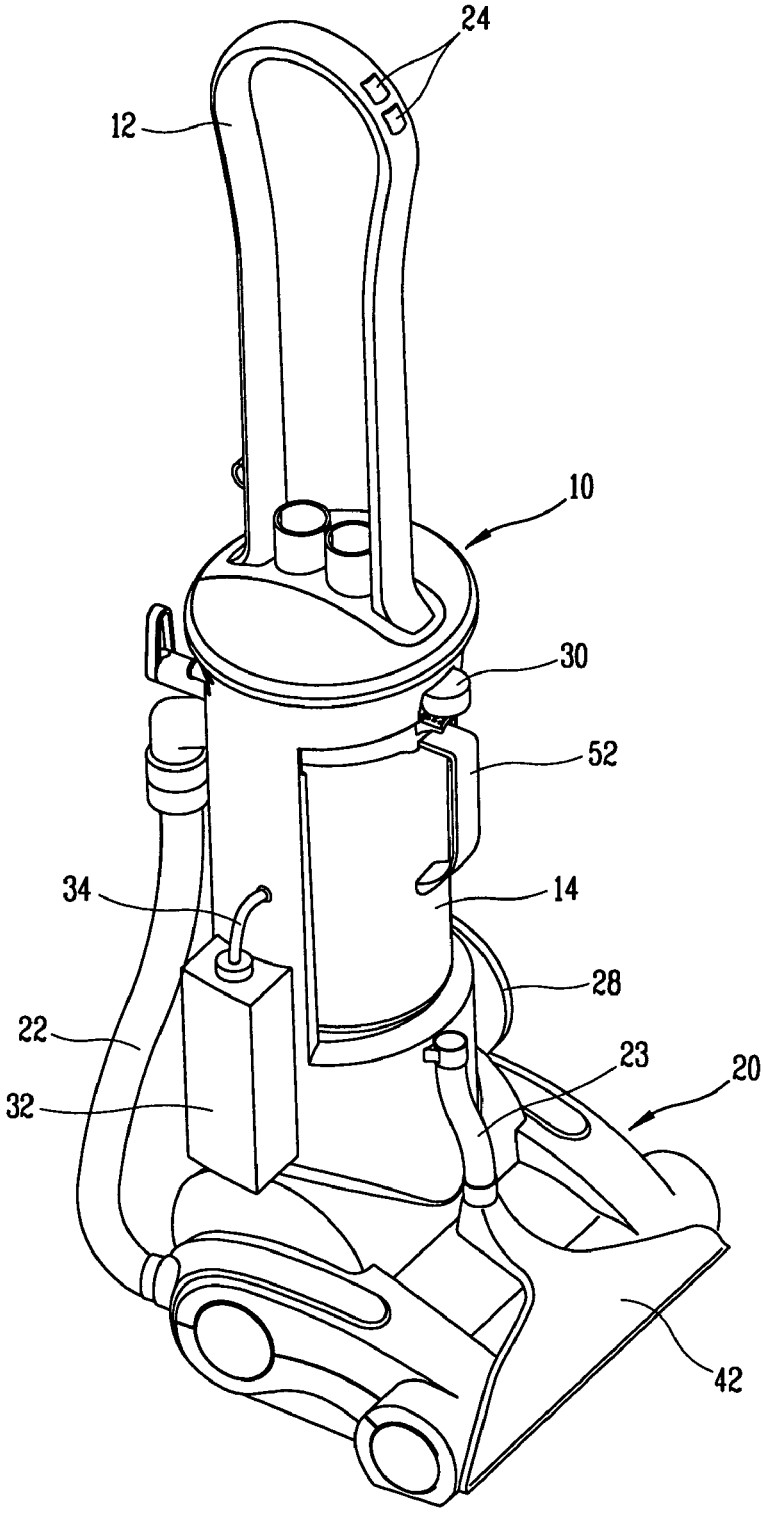
FIG. 1 is a perspective view of a complex type cleaner having a dust collecting container mounted therein in accordance with one embodiment of the present invention.
Figure 2:
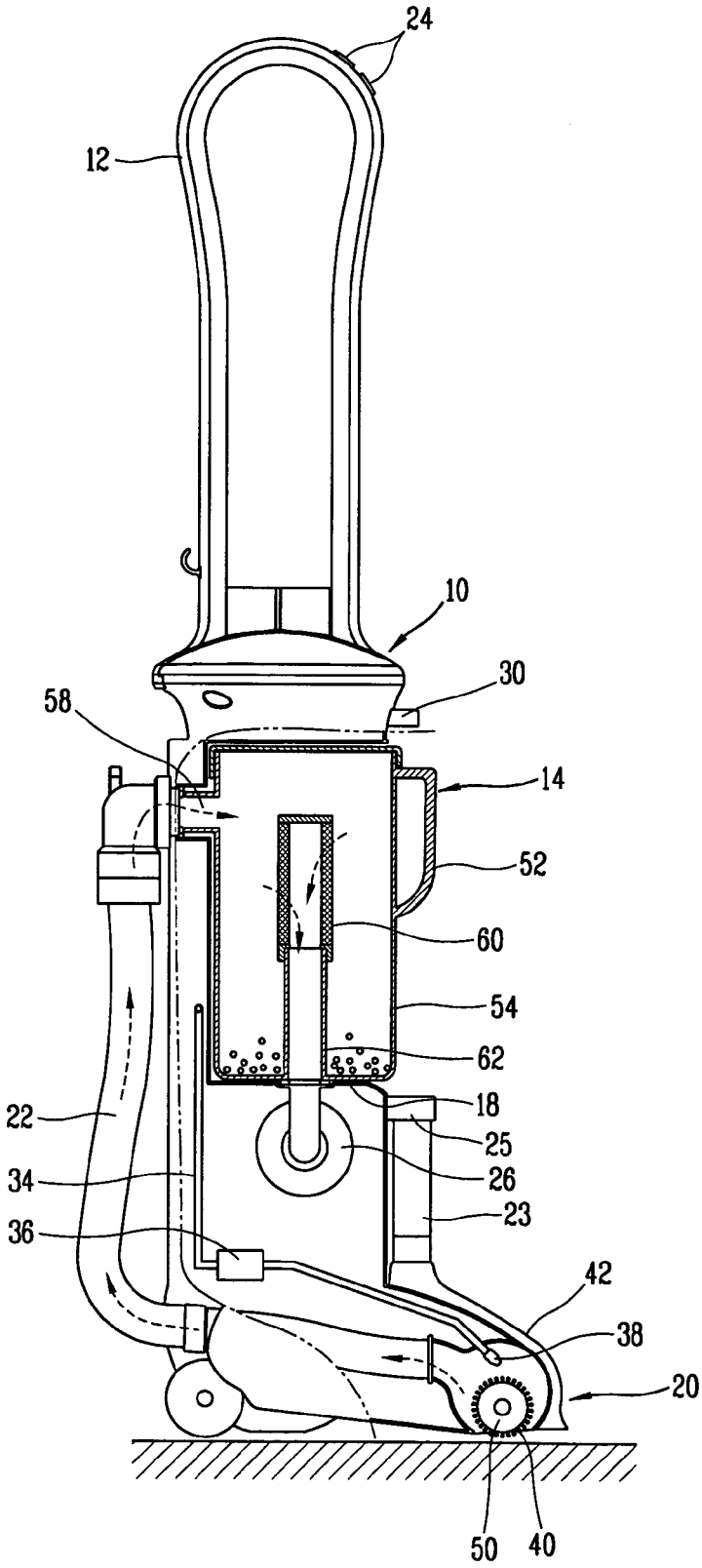
FIG. 2 is a sectional view of the complex type cleaner having a dust collecting container having the water collecting container mounted therein in accordance with one embodiment of the present invention.
Figure 3:
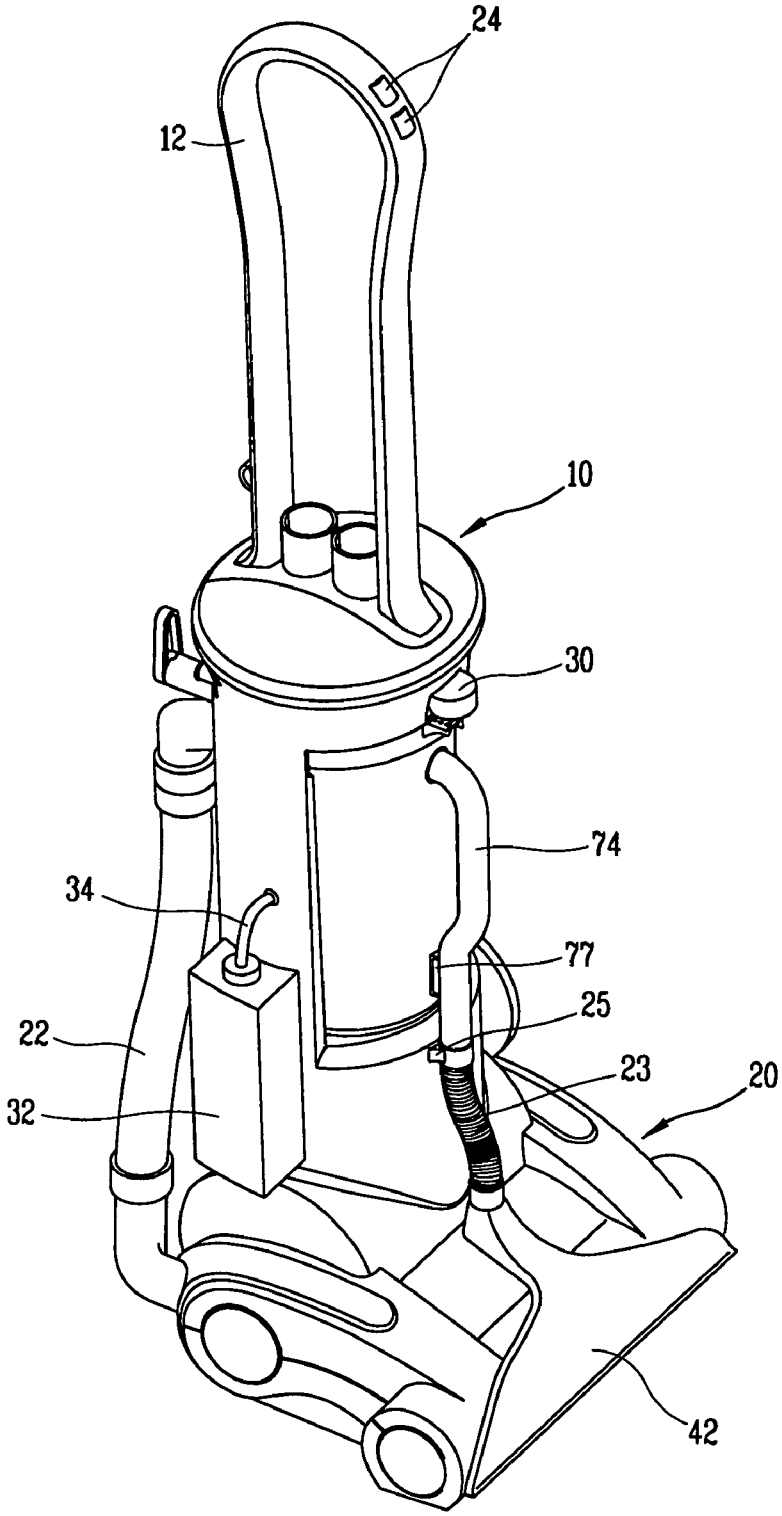
FIG. 3 is a perspective view of a complex type cleaner having a dust collecting container mounted therein in accordance with one embodiment of the present invention.
Figure 4:
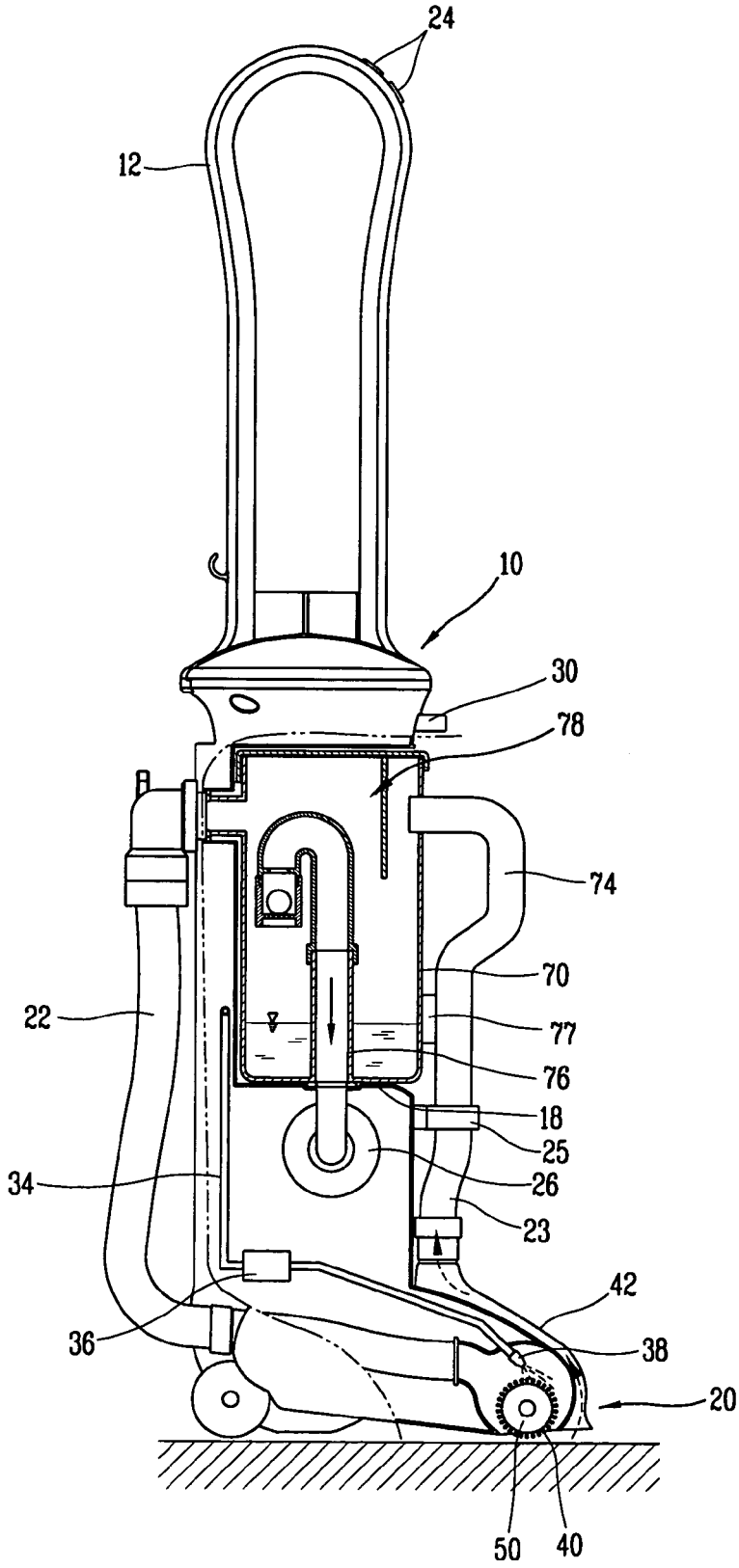
FIG. 4 is a sectional view of the complex type cleaner having a dust collecting container having the water collecting container mounted therein in accordance with one embodiment of the present invention.
Figure 5:
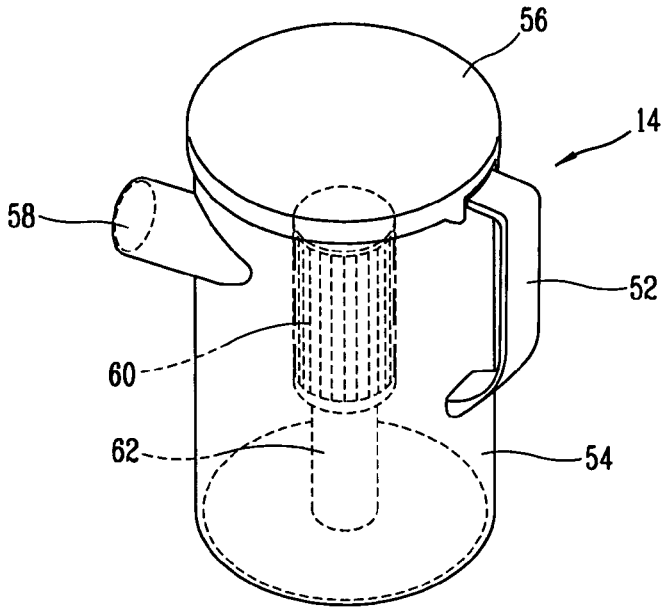
FIG. 5 is a perspective view of the dust collecting container in accordance with one embodiment of the present invention.
Figure 6:
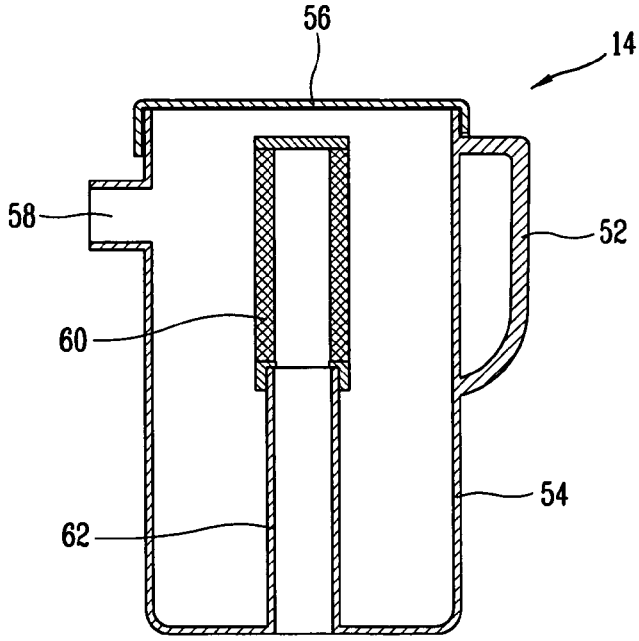
FIG. 6 is a sectional view of the dust collecting container in accordance with one embodiment of the present invention.
Figure 7:
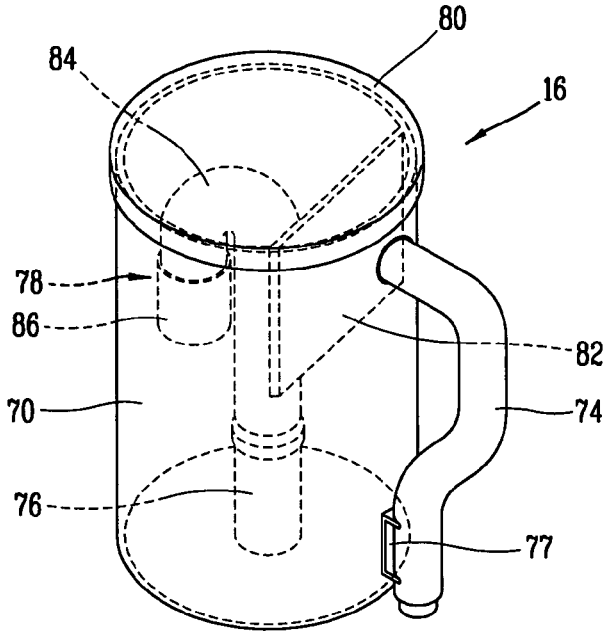
FIG. 7 is a perspective view of the water collecting container in accordance with one embodiment of the present invention.
Figure 8:
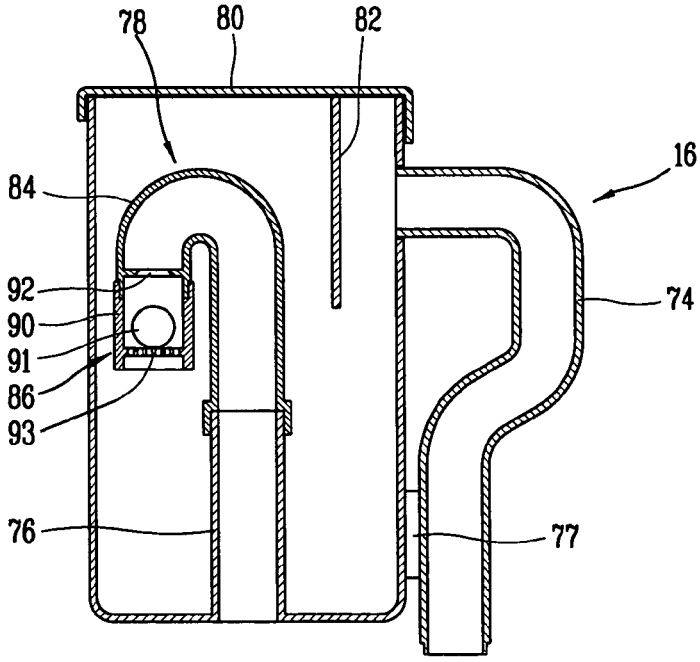
FIG. 8 is a sectional view of the water collecting container in accordance with one embodiment of the present invention.

Reference will now be made in detail to the preferred embodiments of the present invention, examples of which are illustrated in the accompanying drawings.

There can be several embodiments of the present invention for the complex type cleaner, of which the most preferred one will now be described.

The cleaner in accordance with the present invention includes: a cleaner body 10 disposed in a vertically standing state; and a suction head 20 disposed at a lower side of the cleaner body 10 and sucking dust when the cleaner performs a vacuum cleaning and sucking contaminated water when the cleaner performs a water cleaning.

The cleaner body 10 includes a handle 12 mounted at its upper side, a container mounting part 18 where either a dust collecting container 14 for collecting dust or a water collecting container 16 for collecting contaminated water formed at a front side.

Two select switches 24 are mounted on the handle 12 to allow a user to select a vacuum cleaning mode or a water cleaning mode.

A suction fan 26 is mounted at a lower side of the container mounting part 18 and generates a suction force by being connected to the dust collecting container 14 or the water collecting container 16. An exhaust outlet 28 is formed at one side of the suction fan 26 to exhaust air made clean while passing through the dust collecting container 14 or the water collecting container 16.

A locking button 30 for locking either the dust collecting container 14 or the water collecting container 16 to the container mounting part or unlocking it therefrom is installed at a front side of the cleaner body 10. A washing water spray unit for spraying washing water onto a carpet when the cleaner performs a water cleaning function is installed at the side of the cleaner body 10.

The washing water spray unit includes a water tank 32 mounted at the side of the cleaner body 10 and storing washing water; a washing water supply line 34 connected to the water tank 32 and supplying washing water to the suction head 20; a pump 36 installed at the washing water supply line 34 and pumping washing water stored in the water tank 32; and a spray nozzle 38 connected to the end portion of the washing water supply line 34 and spraying washing water pumped by the pump 36 onto the carpet.

A dust suction opening 40 for sucking dust or foreign materials is formed at the bottom surface of the suction head 20. A dust suction hose 22 is connected to a rear side of the suction head 20 in order to guide dust sucked into the dust suction opening 40 to the dust collecting container 14.

A suction nozzle 42 is mounted at the front side of the suction head 20 in order to suck contaminated water which has cleaned the carpet or the floor after being sprayed from the washing water spraying unit in the water cleaning mode of the cleaner.

The suction nozzle 42 and the water collecting container 16 are connected by a water suction hose 23, so that contaminated water sucked through the suction nozzle 42 can be sucked into the water collecting container 16.

The water suction hose 23 is connected at its lower portion to the suction nozzle 42 and its upper portion is fixed to the cleaner body 10 by a fixing member 25. When the cleaner is used in the water cleaning mode, the upper portion of the water suction hose 23 is connected to the water collecting container 16, and when the cleaner is used in the vacuum cleaning mode, the upper portion of the water suction hose 23 is separated from the water collecting container 16.

Preferably, the suction nozzle 42 has a narrow inlet to facilitate sucking contaminated water.

A brush 50 is rotatably mounted at the suction opening 40. When the cleaner is in the vacuum cleaning mode, the brush 50 brushes up dust or foreign materials on the floor or the carpet to the inner side of the suction opening 40, and in case of the water cleaning mode, the brush 50 rubs on the carpet where washing water has been supplied from the washing water spraying unit to wash the carpet.

The dust collecting container 14 includes a cylindrical container 54 mounted on the container mounting part 18 formed on the cleaner body 10 and having a space for collecting dust and a handle 52 formed at one side thereof; a cover 56 mounted at an upper surface of the container 54 and opened and closed; a suction opening 58 formed at one side of the container 54 and sucking dust and foreign materials by being connected to the dust sucking hose 22; a filter 60 disposed inside the container 54 and filtering dust and foreign material sucked into the container 54; and a discharge passage 62 formed at a lower portion of the container 54, connected to the filter 60 to discharge air purified while passing the filter 60, and connected to the suction fan 26.

The filter 60 has a cylindrical form and mounted at an end portion of the discharge passage 62 formed inside the container 54.

When the complex type cleaner performs a water cleaning, the water collecting container 16 is mounted at the container mounting part 18 of the cleaner body 10 and the water collecting container 16 is connected to the water suction hose 23.

The water collecting container 16 includes a container 70 mounted at the container mounting part 18 and having a space for storing contaminant water; a suction pipe 74 connected to the side of the container 70, extended in a downward direction of the container 70, and connected to the water suction hose 23; a discharge passage 76 formed at a lower side of the container 70 and discharging air from the container 70; and a water discharge preventing unit 78 mounted at the discharge passage 76 and preventing contaminated water introduced into the container 70 from being leaked to outside through the discharge passage 76.

The container 70 includes a cylindrical cover 80 formed at an opened upper portion to be opened and closed, and a blocking plate 82 formed inside thereof to prevent water sucked through the suction pipe 74 to be introduced toward the water discharge preventing unit 78.

The suction pipe 74 is connected at its upper portion to the container 70 and fixed at its lower portion to an outer circumferential surface of the container 70 by a fixing member 77. The suction pipe 74 has a bent pipe form to serve as a passage for sucking water therethrough and also as a handle allowing a user to grasp.

The water discharge preventing unit 78 includes a bent pipe 84 mounted at an end portion of the discharge passage 76 and bent at its end portion to be directed toward a lower side to thereby prevent water introduced into the container 70 from being introduced into the discharge passage 76; and a cut-off valve 86 mounted at an end portion of the bent pipe 84 and blocking the end portion of the bent pipe 84 to prevent discharge of water when water introduced into the container 70 reaches a pre-set value.

The cut-off valve 86 includes a valve body 90 mounted at an end portion of the bent pipe 84; a floater 91 inserted to be movable up and down inside the valve body 90; a valve seat 95 formed at an end portion of the bent pipe 84 to close the bent pipe 84 as the floater 91 is tightly attached thereto; and a releaser preventing cap 93 formed at the end portion of the valve body 90 and preventing release of the floater 91.

The floater 91 has a spherical shape and is made of a material so that it does not float when air is sucked into the bent pipe 84 but has buoyancy so as to float in water.

An assembling process of the cut-off valve 86 will now be described.

Figure 9:
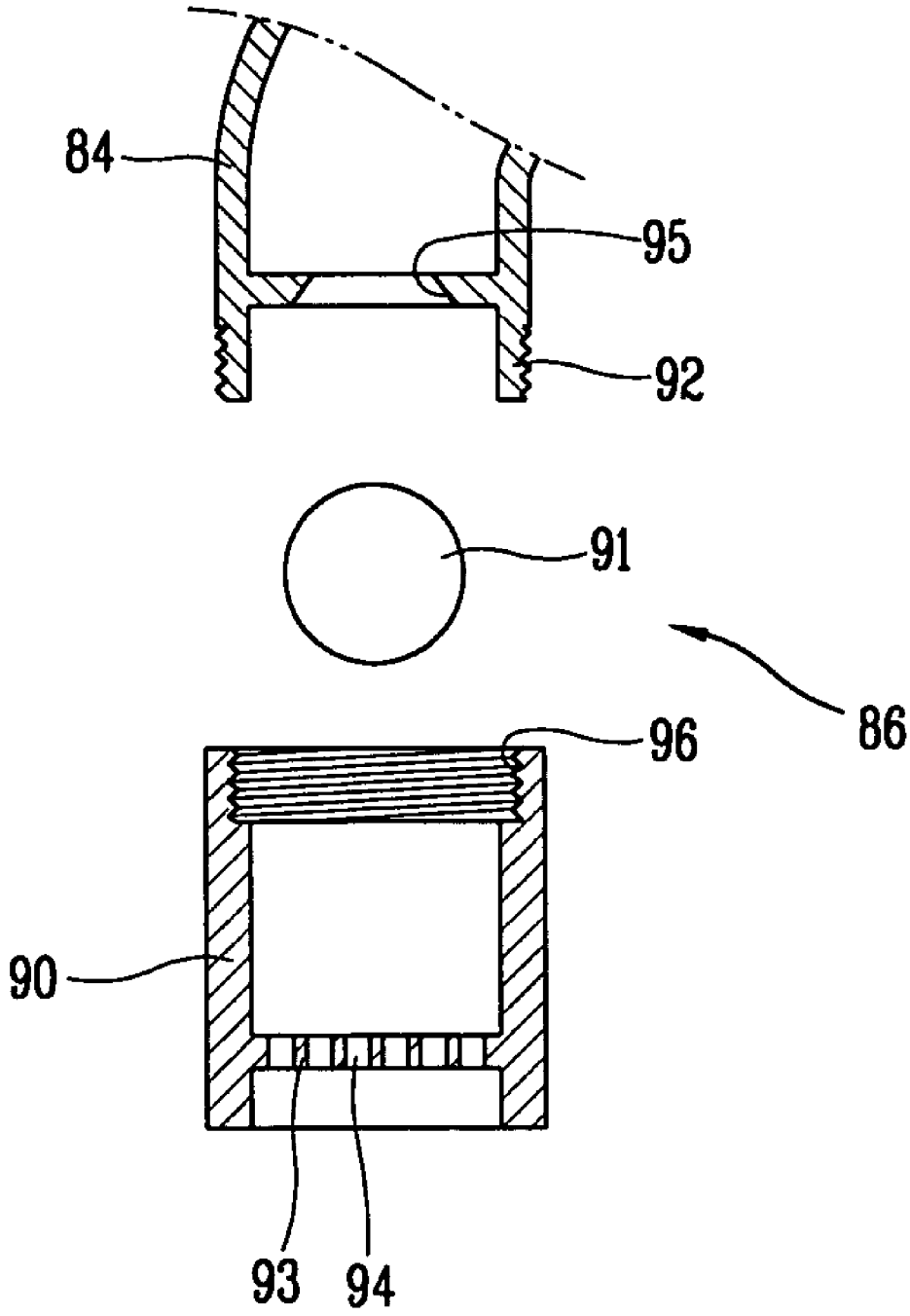
FIG. 9 is an exploded sectional view of a water introduction preventing unit of the water collecting container in accordance with one embodiment of the present invention.
Figure 10:
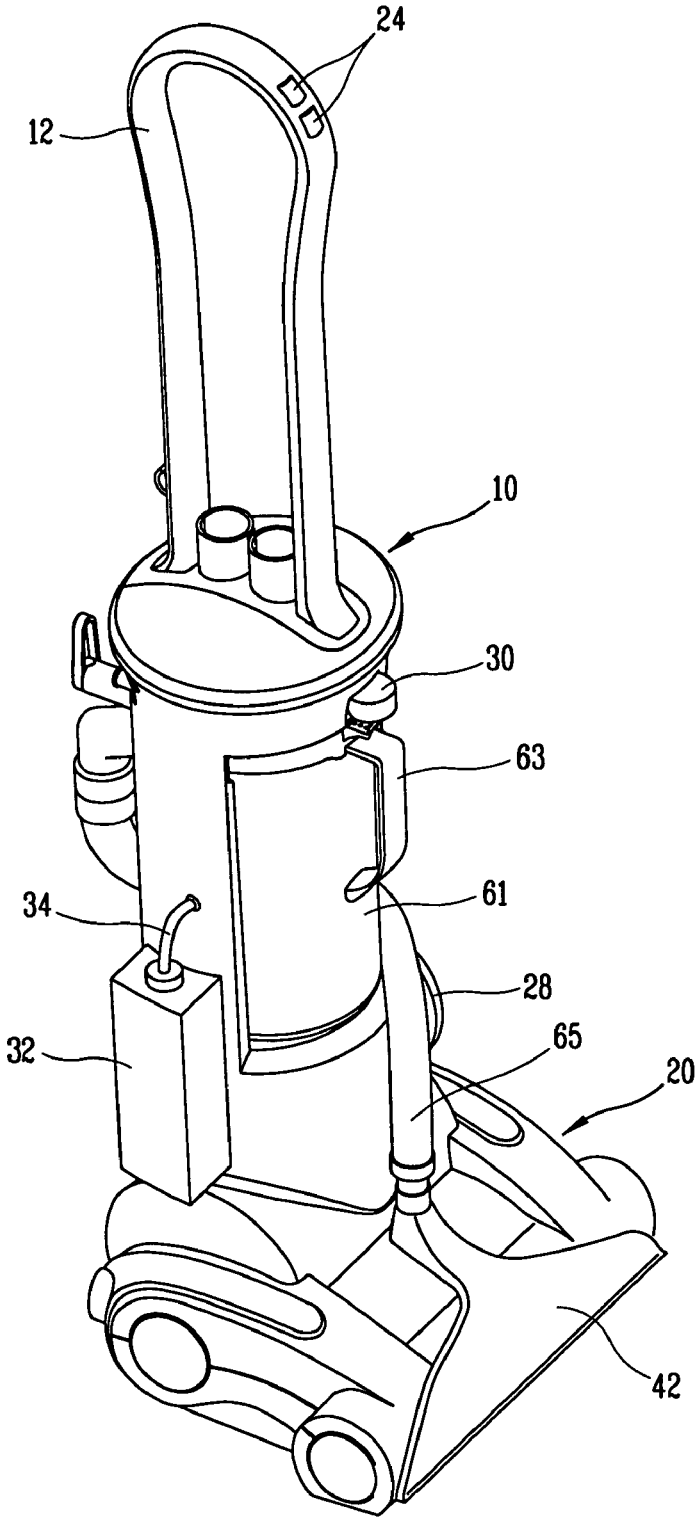
FIG. 10 is a perspective view of a complex type cleaner having a dust collecting container mounted therein in accordance with a second embodiment of the present invention.
Figure 11:
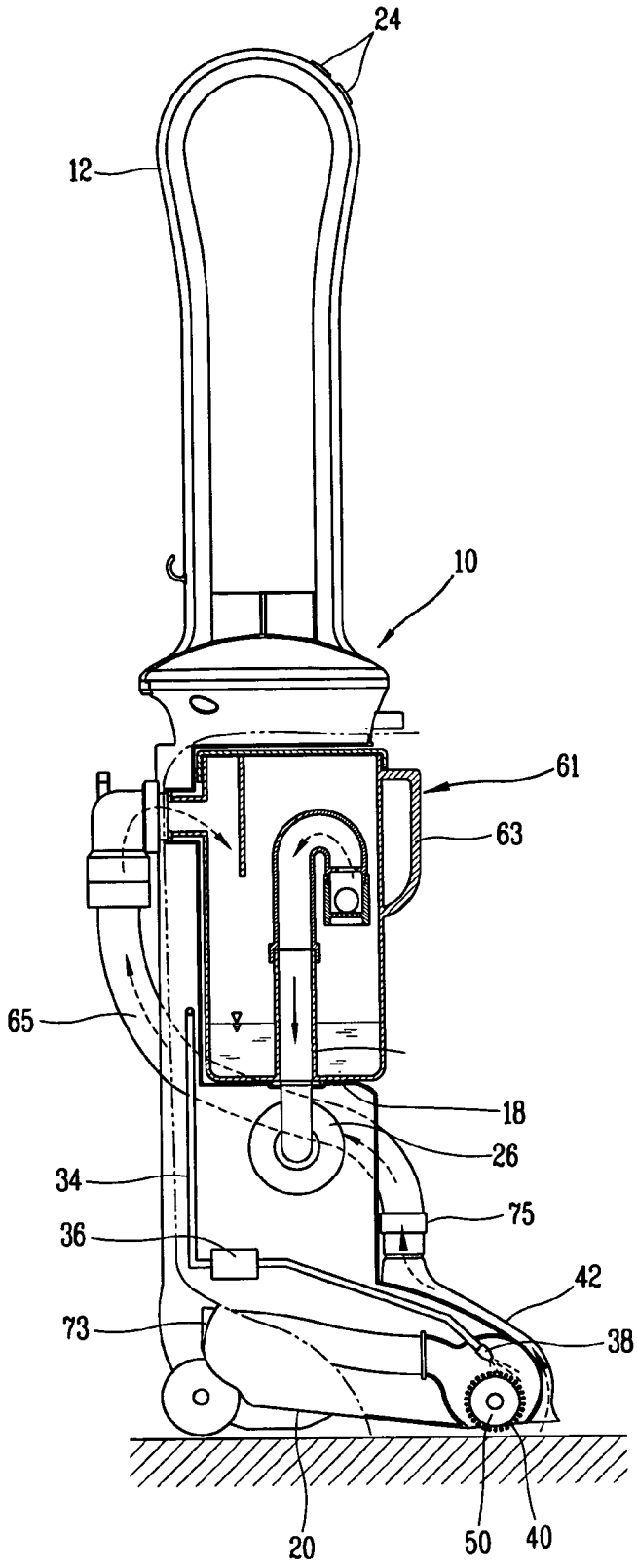
FIG. 11 is a sectional view of the complex type cleaner having a dust collecting container having the water collecting container mounted therein in accordance with the second embodiment of the present invention.

As shown in FIG. 9, a female screw part 96 is formed at an end portion of the valve body 90 and threaded with a male screw part 92 formed at an end portion of the bent pipe 84. The valve seat 95 is integrally formed at the inner circumferential surface of the bent pipe 84. The release preventing cap 93 is integrally formed at an end portion of the valve body 90. A plurality of air suction passages 94 are formed at the release preventing cap 93, through which air is sucked.

The complex type cleaner constructed as described above in accordance with the present invention operates as follows.

When the cleaner is used in the vacuum cleaning mode, the user mounts the dust collecting container 14 on the container mounting part 18 of the cleaner body 10, and operates the select switch 24 to the vacuum cleaning mode.

Then, the suction fan 26 is driven to generate a suction force, and accordingly, dust or foreign materials on the floor or on the carpet is sucked into the suction head 20 through the suction opening 40. At this time, the brush 50 mounted at the suction opening 40 is rotated to brush up dust or foreign materials on the floor or the carpet into the suction head 20. Dust and foreign materials sucked into the suction head 20 is introduced into the container 54 of the dust collecting container 14 through the suction hose 22 and filtered by the filter 60 so as to be collected inside the container 54, and only air purified while passing through the filter 60 is discharged through the discharge passage 62 and then discharged outwardly through the exhaust outlet 28.

When the cleaner is used in the water cleaning mode, the user places the water collecting container 16 of the cleaner body 10, the suction pipe 74 connected to the water collecting container 16 and the water suction hose 23 connected to the suction nozzle 42 are connected, and then, operates the select switch 24 to the water cleaning mode.

Then, the suction fan 26 is driven to generate a suction force and at the same time the pump 36 is driven to spray water onto the floor or the carpet.

Washing water stored in the water tank 32 is guided to the spray nozzle 38 through the water supply line 34 by virtue of the pumping force generated as the pump 36 is driven, and then sprayed onto the floor or the carpet from the spray nozzle 38.

In addition, the brush 50 mounted at the suction head 20 is rotated to rub on the washing water-sprayed carpet to thereby perform a washing operation, and then, contaminated water after finishing washing is sucked through the suction nozzle 42 by virtue of the suction force generated as the suction fan 26 is driven.

Contaminated water sucked through the suction nozzle 42 is introduced into the container 70 of the water collecting container 16 through the suction hose 22, and air introduced together with the contaminated water into the container 70 is outwardly discharged, through the discharge passage 76 formed at the container 70. At this time, the water discharge preventing unit 78 formed at the discharge passage 76 serves to prevent contaminated water stored in the container 70 from being discharged through the discharge passage 76.

The complex type cleaner in accordance with a second embodiment of the present invention features that one suction hose 65 connected to a rear side of the cleaner body 10 is selectively connected to one of the suction head 20 and the suction nozzle 42 in order to guide dust sucked through the suction head 20 to the dust collecting container 14 or guide contaminated water sucked through the suction nozzle 42 to the water collecting container 61.

Namely, in the second embodiment of the present invention, a first connection portion 73, to which the suction hose 65 is connected, is formed at a rear side of the suction head 20, and a second connection portion 75, to which the suction hose 65 is connected, is formed at the suction nozzle 42.

The suction hose 65 is made of a flexible material so that one of the first connection portion 73 formed at the suction head and the second connection portion 75 formed at the suction nozzle 42 can be selectively connected thereto.

Figure 12:
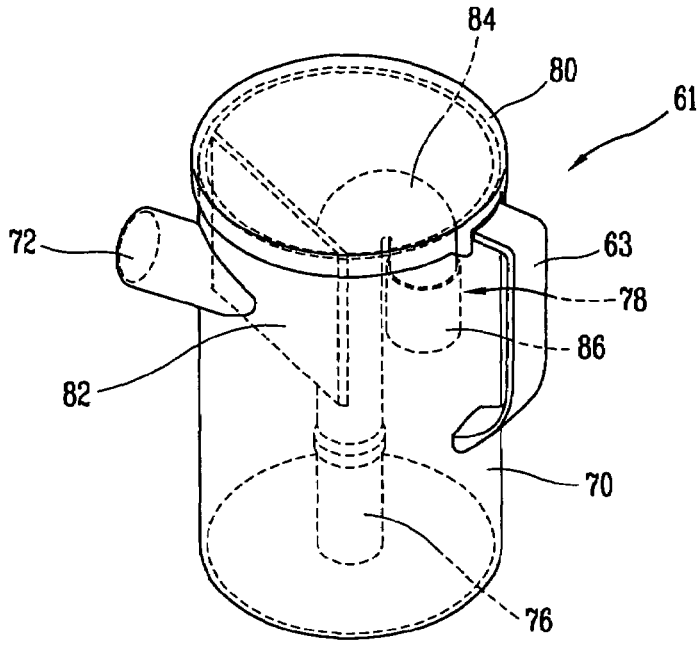
FIG. 12 is a perspective view of a water collecting container in accordance with the second embodiment of the present invention.
Figure 13:
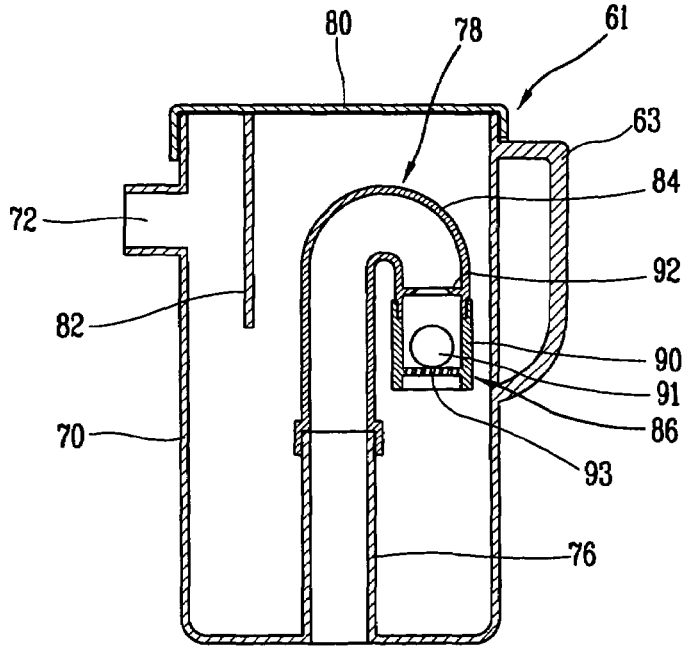
FIG. 13 is a sectional view of a water collecting container in accordance with the second embodiment of the present invention.

With reference to FIGS. 12 and 13, the water collecting container 61 in accordance with the second embodiment of the present invention includes: a container 70 mounted in the container mounting part 18 and having a space for storing contaminated water; a suction opening 72 formed at the side of the container 70 and connected to the suction hose 65 to allow contaminated water to be sucked into the container 70 therethrough; a discharge passage 76 formed at a lower side of the container 70 and externally discharging air sucked together with water into the container 70 therethrough; and a water discharge preventing part 78 mounted at the discharge passage 76 and preventing contaminated water introduced into the container 70 from flowing to outside through the discharge passage 76.

A handle 63 is formed at the side of the water collecting container 61, allowing a user to grasp.

The water discharge preventing unit 78 has the same construction and operation as that of the first embodiment of the present invention, descriptions of which are, thus, omitted.

When the complex type cleaner in accordance with the second embodiment of the present invention is used in the vacuum cleaning mode, the user mounts the dust collecting container 14 in the container mounting part 18 of the cleaner body 10, connects the suction hose 65 to the first connection portion 73 formed at the rear side of the suction head 20, and then, operates the cleaner. Then, dust sucked into the dust suction opening 40 of the suction head 20 is sucked into the dust collecting container 14 through the suction hose 65.

When the cleaner is used in the water cleaning mode, the user mounts the water collecting container 61 in the container mounting part 18 of the cleaner body 10, connects the suction hose 65 to the second connection portion 75 formed at the suction nozzle 20, and then, operates the cleaner. Then, contaminated water which has completed a carpet cleaning after being sprayed from the washing water spray unit is sucked into the suction nozzle 42 and sucked into the water collecting container 61 through the suction hose 65.

The operation of the water discharge preventing unit 78 will now be described in detail.

First, the blocking plate 82 is formed inside the container 70 in order to prevent contaminated water sucked through the suction opening 72 formed at the container 70 from being splashed to the discharge passage 76, and because the bent pipe 84 having an inlet directing toward the lower side is connected to the discharge passage 76, only air sucked into the container 70 through the bent pipe 84 is outwardly discharged through the discharge passage 76.

When contaminated water introduced into the container 70 is increased to reach a pre-set value, the cut-off valve 86 mounted at the end portion of the bent pipe 84 blocks the bent pipe 84 to prevent discharge of water. Namely, when contaminated water increases, the floater 90 floats up to be tightly attached to the valve seat 95 formed at the end portion of the bent pipe 84, thereby preventing contaminated water from being discharged through the bent pipe 84.

As so far described, the complex type cleaner in accordance with the present invention has the following advantages.

That is, for example, when the cleaner is used in the vacuum cleaning mode, the dust collecting container is mounted at the cleaner to suck dust and foreign materials on the floor, and when the cleaner is used in the water cleaning mode, the water collecting container is mounted at the cleaner to suck contaminated water. Accordingly, because one cleaner can be used for the vacuum cleaning and the water cleaning, cost can be reduced, its use is convenient and the cleaner can be easily kept in storage.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A combination vacuum cleaner comprising:

a cleaner body where one of a dust collecting container configured to store dust or foreign materials and a water collecting container configured to store contaminated water is selectively mounted; and a suction head having a dust suction opening disposed at a lower portion of the cleaner body to suck dust when the cleaner performs a vacuum cleaning and a suction head having a suction nozzle to suck contaminated water when the cleaner performs a water cleaning, wherein the dust suction opening of the suction head and the dust collecting container are connected by a dust suction hose so that dust sucked into the dust suction opening is guided to the dust collecting container, and the suction nozzle and the water collecting container are connected by a water suction hose so that water sucked into the suction nozzle is guided to the water collecting container.

2. The cleaner of claim 1, wherein the water collecting container comprises:

a container having a space configured to store contaminated water;

a suction pipe connected to the container and extended in a downward direction of the container so as to be connected to the water suction hose;

a discharge passage formed at a lower side of the container and externally discharging air sucked together with water into the container; and a water discharge preventing unit mounted at the discharge passage and preventing contaminated water introduced into the container from being leaked through the discharge passage.

3. The cleaner of claim 2, wherein the suction pipe has a plurality of bent portions that guide water and serves as a handle.

4. The cleaner of claim 2, wherein a cut-off plate is installed inside the container in order to prevent introduction of water sucked through the suction opening to the water discharge preventing unit.

5. The cleaner of claim 2, wherein the water discharge preventing unit comprises:

a bent pipe mounted at an end portion of the discharge passage and bent downwardly; and a cut-off valve mounted at an end portion of the bent pipe and preventing water from being discharged by blocking the end portion of the bent pipe when water introduced into the container reaches a pre-set value.

6. The cleaner of claim 5, wherein the cut-off valve comprises:

a valve body mounted at the end portion of the bent pipe;

a floater inserted to be movable vertically inside the valve body to float up to contact a valve seat formed at the bent pipe when water is filled; and a release preventing cap formed at an end portion of the valve body and preventing release of the floater.

7. The cleaner of claim 6, wherein the floater has a spherical shape and is made of a material having buoyancy so as to float in water, and the release preventing cap includes a plurality of air suction passages that sucks air.

8. The cleaner of claim 2, wherein the water suction hose is formed in a flexible form, one end of the water suction hose is connected to the suction nozzle, the other end of the water suction hose is connected to the suction pipe, and one side of the water suction hose is fixed to the cleaner body.

9. The cleaner of claim 1, wherein one of the dust and water suction hoses is provided at a rear side of the cleaner body in order to guide dust or water to the dust collecting container or to the water collecting container.

10. The cleaner of claim 9, wherein a first connection portion selectively connected to the suction hose is formed at the a rear side of the suction head and a second connection portion selectively connected to the suction hose is formed at the suction head.

11. The cleaner of claim 10, wherein the suction hoses are made of a flexible material so as to be selectively connected to one of the first connection portion and the second connection portion.

12. The cleaner of claim 9, wherein the water collecting container comprises:

a container having a space that stores contaminated water;

a suction opening formed at one side of the container and sucking contaminated water by being connected to the suction hose;

a discharge passage formed at a lower side of the container and discharging air sucked into the container; and a water discharge preventing unit mounted at the discharge passage and preventing contaminated water introduced into the container from flowing outwardly through the discharge passage.

* * * * *

UNITED STATES PATENT AND TRADEMARK OFFICE

CERTIFICATE OF CORRECTION

PATENT NO. : 7,377,009 B2
APPLICATION NO. : 10/879106
DATED : May 27, 2008
INVENTOR(S) : Lee et al.

It is certified that error appears in the above-identified patent and that said Letters Patent is hereby corrected as shown below:

At column 9, line 14 (claim 10 line 3) of the printed patent, “at the a rear” should read --at a rear--.

Signed and Sealed this

Eleventh Day of November, 2008

JON W. DUDAS
*Director of the United States Patent and Trademark Office*